US010155379B2

(12) United States Patent
Ng et al.

(10) Patent No.: US 10,155,379 B2
(45) Date of Patent: Dec. 18, 2018

(54) FLUID EJECTION DEVICE WITH PRINTHEAD INK LEVEL SENSOR

(71) Applicant: HEWLETT-PACKARD DEVELOPMENT COMPANY, L.P., Houston, TX (US)

(72) Inventors: Boon Bing Ng, Singapore (SG); Hang Ru Goy, Singapore (SG); Patrick Leonard, Leixlip (IE); Shane O'Brien, Leixlip (IE)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/519,310

(22) PCT Filed: Oct. 29, 2014

(86) PCT No.: PCT/US2014/062926

§ 371 (c)(1),
(2) Date: Apr. 14, 2017

(87) PCT Pub. No.: WO2016/068913

PCT Pub. Date: May 6, 2016

(65) Prior Publication Data

US 2017/0232743 A1 Aug. 17, 2017

(51) Int. Cl.

| | |
|---|---|
| ***B41J 2/14*** | (2006.01) |
| ***B41J 2/175*** | (2006.01) |
| ***B41J 2/16*** | (2006.01) |

(52) U.S. Cl.

CPC ..... *B41J 2/14072* (2013.01); *B41J 2/14153* (2013.01); *B41J 2/1601* (2013.01); (Continued)

(58) Field of Classification Search

None

See application file for complete search history.

(56) References Cited

U.S. PATENT DOCUMENTS

| | | | |
|---|---|---|---|
| 7,681,972 | B2 | 3/2010 | Sakurai |
| 7,845,224 | B2 | 12/2010 | Barlesi et al. |

(Continued)

FOREIGN PATENT DOCUMENTS

| | | | |
|---|---|---|---|
| CN | 101480875 | A | 7/2009 |
| CN | 102036829 | A | 4/2011 |

(Continued)

OTHER PUBLICATIONS

IP.com search.*

Reverter, F. et al. "Liquid-level Measurement System Based on a Remote Grounded Capacitive Sensor." Apr. 10, 2007.

*Primary Examiner* — Lisa M Solomon

(74) *Attorney, Agent, or Firm* — HP Inc.—Patent Department

(57) ABSTRACT

A fluid ejection device including a printhead die having a plurality of layers, including a single metal layer, and having an integrated ink level sensor. The ink level sensor includes an ink chamber above the metal layer, a metal plate of a sense capacitor disposed in the metal layer, and a clearing resistor circuit disposed in the metal layer including four clearing resistors arranged in a surround-4 configuration about the metal plate and electrically connected in parallel between a voltage potential and ground, wherein adjacent ends of at least two clearing resistors are not directly connected to one another so as to leave a gap between the adjacent ends in the metal layer. A metal lead in the metal layer extends through the gap to the metal plate.

20 Claims, 12 Drawing Sheets

(52) U.S. Cl.
CPC ..... *B41J 2/164* (2013.01); *B41J 2/175* (2013.01); *B41J 2202/18* (2013.01)

(56) References Cited

U.S. PATENT DOCUMENTS

| | | | |
|---|---|---|---|
| 8,410,562 | B2 | 4/2013 | Lazarus et al. |
| 8,517,522 | B2 | 8/2013 | Bibl |
| 9,487,017 | B2 | 11/2016 | Ge et al. |
| 2009/0058914 | A1 | 3/2009 | Kim et al. |
| 2011/0128335 | A1 | 6/2011 | Von Essen et al. |
| 2013/0278688 | A1 | 10/2013 | Bibl |
| 2014/0204148 | A1 | 7/2014 | Ge et al. |

FOREIGN PATENT DOCUMENTS

| | | | | |
|---|---|---|---|---|
| CN | 103442896 | A | 12/2013 | |
| CN | 103619605 | A | 3/2014 | |
| TW | 201425056 | A | 7/2014 | |
| WO | WO 2014084843 | | 6/2014 | |
| WO | WO 2014084843 | A1 * | 6/2014 | ..... B41J 2/17566 |

* cited by examiner

FLUID EJECTION DEVICE WITH PRINTHEAD INK LEVEL SENSOR

BACKGROUND

Accurate ink level sensing of ink supply reservoirs of inkjet printers is desirable for many reasons. For example, sensing the correct ink level and providing indication of the amount of ink left in an ink cartridge enables printer users to prepare to replace ink cartridges. Accurate ink level indication also helps to avoid wasting ink by avoiding premature replacement of ink cartridges which might still contain ink. Additionally, printing systems can use ink level sensing to initiate actions to help prevent low quality prints that might otherwise result from inadequate supply levels. Many techniques are employed for determining the level of ink in a reservoir or fluidic chambers, challenges remain related to their accuracy and cost.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Figure 1:
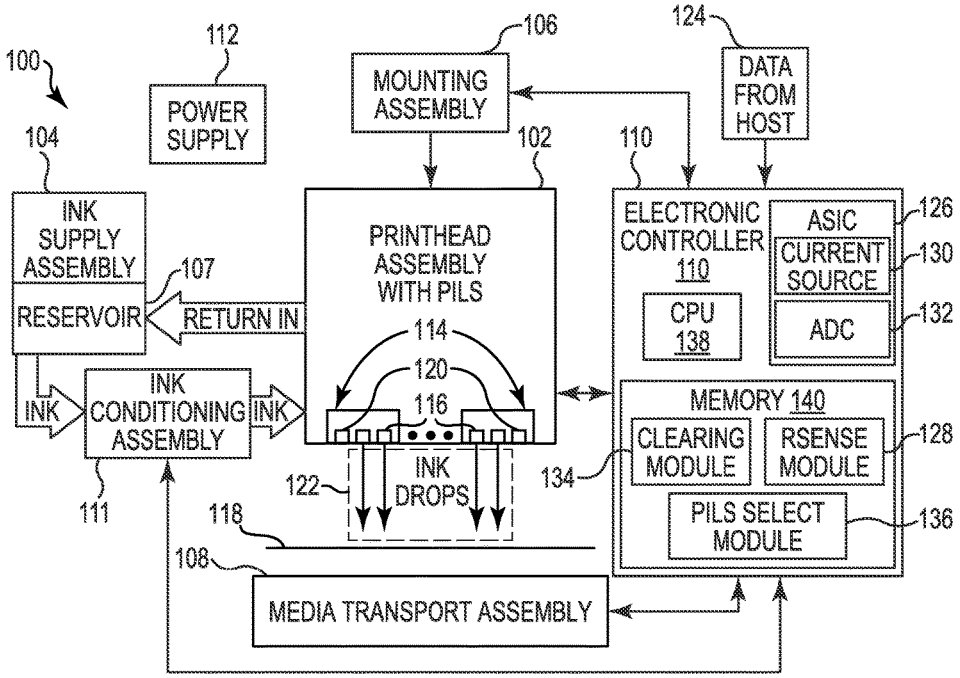
FIG. 1 is a block and schematic diagram illustrating an inkjet printing system including a fluid ejection device having a printhead-integrated ink level sensor according to one example.

FIG. 1 is a block and schematic diagram illustrating generally an inkjet printing system 100 including a fluid ejection device, such as a fluid drop ejecting printhead, having a printhead-integrated ink level sensor (PILS), according to the present disclosure, which provides accurate ink level sensing by eliminating parasitic capacitance due to conductor routing in the printhead. Inkjet printing system 100 includes an inkjet printhead assembly 102, an ink supply assembly 104 including an ink storage reservoir 107, a mounting assembly 106, a media transport assembly 108, an electronic controller 110, and at least one power supply 112 that provides power to the various electrical components of inkjet printing system 100.

Inkjet printhead assembly 102 includes at least one fluid ejection assembly 114 that ejects drops of ink through a plurality of orifices or nozzles 116 toward print media 118 so as to print onto print media 118. According to one example, fluid ejection assembly 114 is implemented as a fluid drop jetting printhead 114 (printhead 114). Printhead 114 includes nozzles 116, which are typically arranged in one or more columns or arrays, with properly sequenced ejections of ink drops from nozzles 116 resulting in characters, symbols or other graphics or images to be printed on print media 118 as inkjet printhead assembly 102 and print media 118 are moved relative to each other. In one example, printhead 114 includes at least one PILS 120, according to the present disclosure, which will be described in greater detail below, for accurately measuring an amount of ink available, such as an amount in ink in reservoir 105, for generation of ink drops by nozzles 116.

Although described herein primarily with regard to inkjet printing system 100, which is disclosed as a drop-on-demand thermal inkjet printing system with a thermal inkjet (TIJ) printhead 114 which is suitable for implementation of PILS 120, PILS 120 can also be implemented printhead types as well. For example, PILS 120 may be implemented in an inkjet printhead assembly having a wide array of TIJ printheads 114. According to other examples, PILS 120, according to the present disclosure, may be implemented with a piezoelectric type printhead. As such, PILS 120, according to the present disclosure, is not limited to implementation in a TIJ printhead, such as printhead 114.

Figure 2:
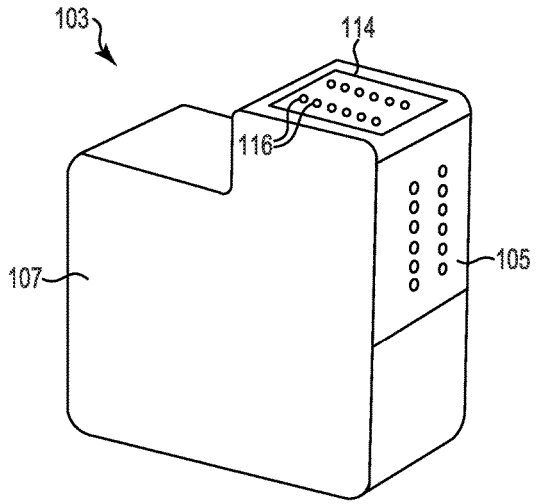
FIG. 2 is a perspective view of an example inkjet cartridge including a fluid ejection device having a printhead-integrated ink level sensor according to one example

As illustrated by FIG. 2, in one implementation, inkjet printhead assembly 102 and ink supply assembly 104, including ink storage reservoir 105, are housed together in a replaceable device, such as an integrated inkjet printhead cartridge 103. FIG. 2 is a perspective view illustrating inkjet printhead cartridge 103 including printhead assembly 102 and ink supply assembly 104, including ink reservoir 107, with printhead assembly 102 further including one or more printheads 114 having nozzles 116 and PILS 120, according to one example of the present disclosure. In one example, ink reservoir 107 stores one color of ink, while in other examples, ink reservoir 107 may have include a number of reservoirs each storing a different color of ink. In addition to one or more printheads 114, inkjet cartridge 103 includes electrical contacts 105 for communicating electrical signals between electronic controller 110 and other electrical components of inkjet printing system 100 for controlling various functions including, for example, the ejection of ink drops via nozzles 116 and ink level measurements via PILS 120.

Returning to FIG. 1, in operation, ink typically flows from reservoir 107 to inkjet printhead assembly 102, with ink supply assembly 104 and inkjet printhead assembly 102 forming either a one-way ink delivery system or a recirculating ink delivery system. In a one-way ink delivery system, all of the ink supplied to inkjet printhead assembly 102 is consumed during printing. However, in a recirculating ink delivery system, only a portion of the ink supplied to printhead assembly 102 is consumed during printing, with ink not consumed during printing being returned to supply assembly 104. Reservoir 107 may be removed, replaced, and/or refilled.

In one example, ink supply assembly 104 supplies ink under positive pressure through an ink conditioning assembly 11 to inkjet printhead assembly 102 via an interface connection, such as a supply tube. Ink supply assembly includes, for example, a reservoir, pumps, and pressure regulators. Conditioning in the ink conditioning assembly may include filtering, pre-heating, pressure surge absorption, and degassing, for example. Ink is drawn under negative pressure from printhead assembly 102 to the ink supply assembly 104. The pressure difference between an inlet and an outlet to printhead assembly 102 is selected to achieve correct backpressure at nozzles 116, and is typically a negative pressure between negative 1 and negative 10 of H20.

Mounting assembly 106 positions inkjet printhead assembly 102 relative to media transport assembly 108, and media transport assembly 108 positions print media 118 relative to inkjet printhead assembly 102, so that a print zone 122 is defined adjacent to nozzles 116 in an area between inkjet printhead assembly 102 and print media 118. In one example, inkjet printhead assembly 102 is scanning type printhead assembly. According to such example, mounting assembly 106 includes a carriage from moving inkjet printhead assembly 102 relative to media transport assembly 108 to scan printhead 114 across printer media 118. In another example, inkjet printhead assembly 102 is a non-scanning type printhead assembly. According to such example, mounting assembly 106 maintains inkjet printhead assembly 102 at a fixed position relative to media transport assembly 108, with media transport assembly 108 positioning print media 118 relative to inkjet printhead assembly 102.

Electronic controller 110 includes a processor (CPU) 138, a memory 140, firmware, software, and other electronics for communicating with and controlling inkjet printhead assembly 102, mounting assembly 106, and media transport assembly 108. Memory 140 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for inkjet printing system 100. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic controller 110 controls inkjet printhead assembly for ejection of ink drops from nozzles 116 of printheads 114. Electronic controller 110 defines a pattern of ejected ink drops to form characters, symbols, and/or other graphics or images on print media 118 based on the print job commands and/or command parameters from data 124.

In one example, electronic controller 110 includes a printer application specification integrated circuit (ASIC) 126 for determining the level of ink in fluid ejection device/printhead 114 based on resistance values from one or more PILS 120 integrated on printhead 114. In one example, ASIC 126 includes a current source 130 and an analog-to-digital converter (ADC) 132, where ASIC 126 converts a voltage present at current source 130 to determine a resistance and determines a corresponding digital value via ADC 132. A programmable algorithm implemented through executable instructions within a resistance-sense module 128 in memory 140 enable the resistance determination and subsequent digital conversion through ADC 132.

In one example, memory 140 includes an ink clearing module 134 that includes instructions executable by processor 138 to activate a clearing resistor circuit to purge ink and/or ink residue out of a of a chamber of a PILS 120, as will be described in greater detail below. According to one example, where printhead 114 includes multiple PILS 120, memory 140 includes a PILS select module 136 executable by processor 138 for selecting individual PILS 120 to be used to measure ink levels.

Figure 3:
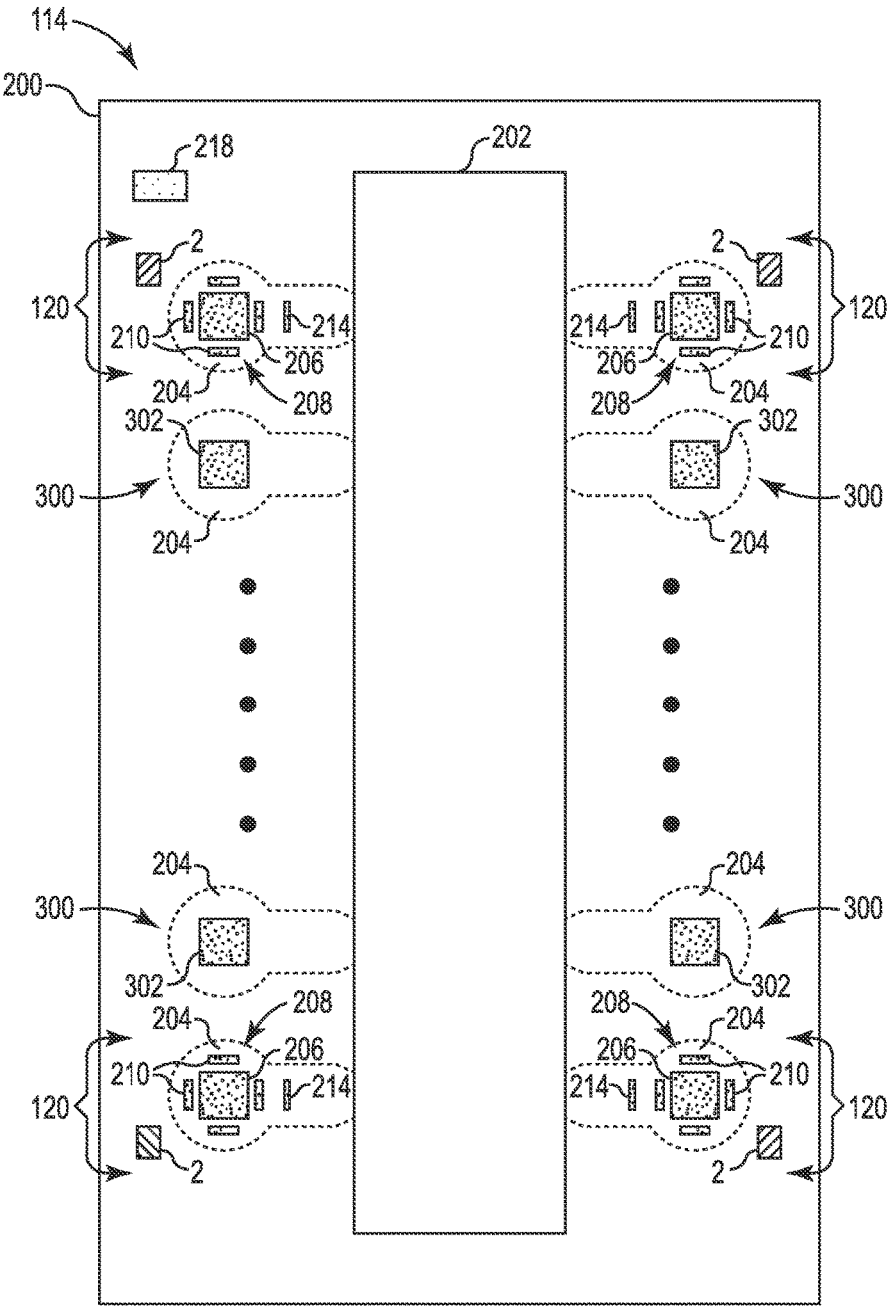
FIG. 3 is a block and schematic diagram generally illustrating printhead according to one example.

FIG. 3 is a block and schematic diagram generally illustrating printhead 114 according to one example. Printhead 114 includes a silicon die/substrate 200 having a fluid slot 202 formed therein, and various integrated components including one or more PILS 120 and fluid drop generators 300 arranged along the sides and in fluid communication with fluid slot 202. As described below, each fluid drop generator 300 includes a firing element 302 (e.g. a thermal resistor) disposed proximate to fluid/ink chamber 204 for the formation of ink drops to be ejected from drop generator 300 onto print media 118.

As will also be described in greater detail below, each PILS 120 includes a fluid/ink chamber 204 in fluid communication with fluid slot 202, a plate sense capacitor 206, a clearing resistor circuit 208 including clearing resistors 210, sensor circuitry 220 incorporating sense capacitor 206, and a ground 214 to provide a ground for sensor capacitor 206 via a fluid (e.g. ink, ink-air, air) contained in fluid chamber 204. Clearing resistors 210 of clearing resistor circuit 208 are illustrated as being configured in what is referred to as a surround-four configuration, wherein a clearing resistor 210 is positioned on each side of rectangular plate sense capacitor 206.

It is noted that printhead 114 may include more than one fluid slot 202. Additionally, although illustrated as being positioned near the ends of fluid slot 202, PILS 120 may be disposed at other locations along the length of fluid slot 202.

Figure 4:
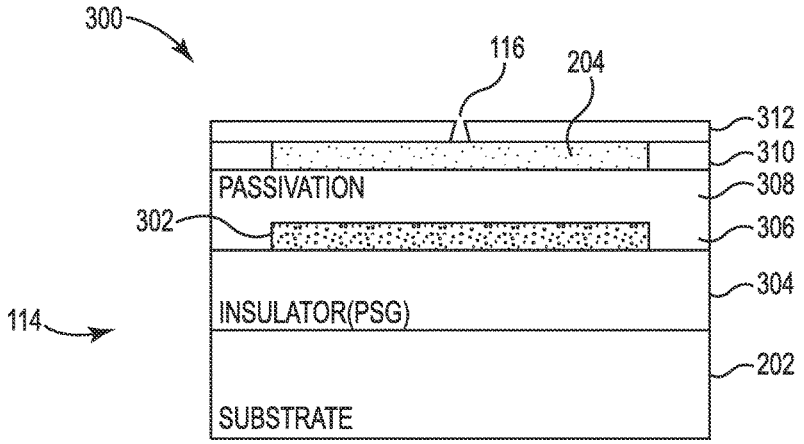
FIG. 4 is a cross-sectional view of a portion of printhead generally illustrating a drop generator according to one example.

FIG. 4 is a cross-sectional view of a portion of printhead 114 generally illustrating a drop generator 300 according to one example. Printhead 114 includes multiple layers including a substrate 202 (e.g. silicon), an insulator layer 304 (e.g. polysilicon glass), a metal layer 306, a passivation layer disposed 308 over metal layer 306 (e.g. Tantalum-Aluminum, TaAl), a chamber layer 310, and a nozzle layer 312. Fluid/ink chamber 204 is formed in chamber layer 308 and is in fluid communication with and receives ink from fluid slot 202, with fluid/ink chambers 204 being arranged in columns along the sides of fluid slot 202 (see FIG. 3). Nozzles 116 are formed in nozzle layer 312 and are arranged in columns along the side of fluid slot 202 above fluid/ink chambers 204. According to one example, firing element 302 is a thermal resistor formed in metal layer 306 below fluid/ink chamber 204 and nozzle 116. Passivation layer 308 protects firing element 302 from ink in fluid/ink chamber 204 and acts as a mechanical passivation or protective cavitation barrier to absorb shock generated by the collapse of vapor bubbles in fluid/ink chamber 204.

During operation, operation, an electric current pulse is passed through thermal resistor firing element 302 which results in rapid heating of the element. A thin layer of fluid, such as ink, within fluid/ink chamber 204 immediately adjacent to passivation layer 304 over firing element 302 is superheated, creating a vapor bubble in the fluid within chamber 204. The rapidly expanding vapor bubble forces a fluid drop out of nozzle 116. When the heating element cools, the vapor bubble quickly collapses, drawing more fluid from fluid slot 202 into fluid/ink chamber 204 in preparation for ejecting another fluid drop from nozzle 116.

Figure 5:
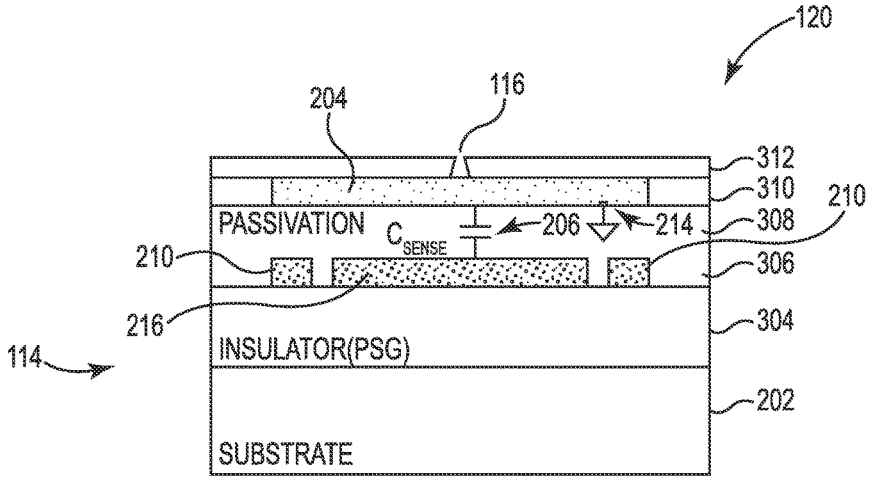
FIG. 5 is a cross-sectional view of a portion of printhead generally illustrating a printhead integrated ink level sensor according to one example.

FIG. 5 is a cross-sectional view of a portion of printhead 114 generally illustrating a PILS 120 according to one example of the present disclosure. With additional reference to FIGS. 1 and 3, PILS 120 is generally configured in a manner similar to that of drop generator 300, but rather than a firing element, a conductive element, such as metal plate 216, is formed in metal layer 306 below fluid/ink chamber 204, wherein metal plate 216, the contents of fluid/ink chamber 204 (which are grounded via ground connection 214), and the material of passivation layer 308 disposed there between together form sense capacitor 206. Additionally, as described above by FIG. 3, PILS 120 includes a clearing resistor circuit 208 formed in metal layer 306, including clearing resistors 210. Furthermore, as described above, PILS 120 employs a current source 130 and analog-to-digital converter (ADC) 132 from a printer ASIC 126 that is not integrated with printhead 114, but is instead located, for example, on the printer carriage or electronic controller 100 of printer system 100.

Sensor circuitry 220 incorporates sense capacitor 206 and enables the determination of a fluid level (e.g. ink) within fluid/ink chamber 204 based on a value of sense capacitor 206, which changes as the substance within chamber 204 changes. According to one example, the substance within chamber 206 can be all ink, partially ink and partially air, or all air, with the value of sense capacitor 206 changing with the level of ink in chamber 204. Sense capacitor 206 has its highest capacitance value (i.e. 100%) when chamber 204 is filled with ink since the ink provides sense capacitor 206 with good conductance to ground 214. Conversely, sense capacitor 206 has its lowest capacitance value, which is ideally close to zero, when chamber 204 is devoid of ink (i.e. filled with air only). Similarly, when chamber 204 is partially filled with ink, the capacitance value of sense capacitor 206 is somewhere between zero and 100%. As such, using the changing capacitance value of sense capacitor 206 enables a determination of the ink level in fluid/ink chamber 204 which, in-turn, is indicative of an ink level in reservoir 107 of printer system 100.

Figure 6:
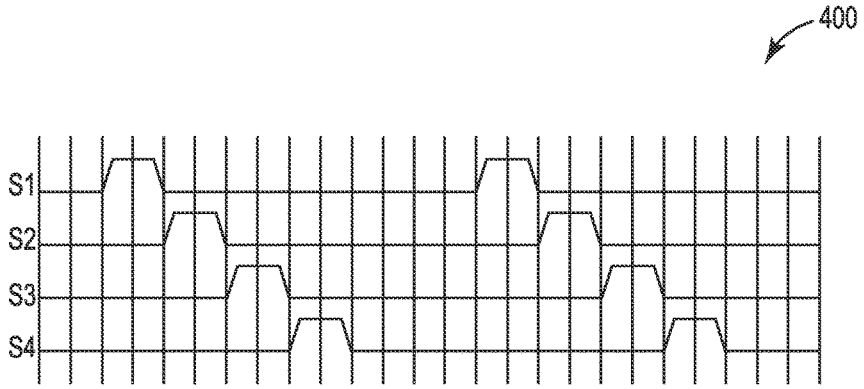
FIG. 6 is an example of a partial timing diagram.

FIG. 6 illustrates an example of a partial timing diagram 400 having non-overlapping clock signals (S1-S4) with synchronized data and fire signals that may be used to drive printhead 114, according to one example of the present disclosure. As described below, clock signals S1-S4 are also used to drive the operation of ink level sensor circuitry 220 of PILS 120.

Figure 7:
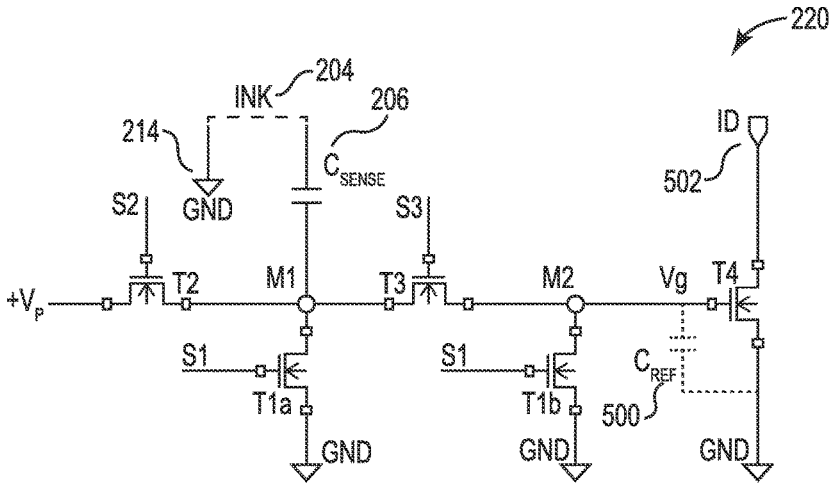
FIG. 7 is a schematic diagram illustrating ink level sensor circuitry of a printhead integrated ink level sensor according to one example.

FIG. 7 is a schematic diagram illustrating ink level sensor circuitry 220 of PILS 120 according to one example of the present disclosure. Sensor circuit 220 includes two first transistors T1 (T1*a*, T1*b*) which are configured as switches. During operation of sensor circuit 220, with reference to the timing diagram of FIG. 6, clock pulse S1 closes transistor switches T1*a* and T1*b*, coupling memory nodes M1 and M2 to ground and discharging sense capacitor 206 and reference capacitor 500. In one example, as illustrated, reference capacitor 500 is implemented as the inherent gate capacitance of evaluation transistor T4 and, as such, is illustrated using dashed lines.

While reference capacitor 500 additionally includes associated parasitic capacitances, such as gate-source overlap capacitance, for example, the gate capacitance of transistor T4 is the dominant capacitance in reference capacitor 500. Using the gate capacitance of transistor T4 as reference capacitor 500 reduces the number of components in sensor circuit 220 by avoiding the need for a specific reference capacitor to be fabricated and disposed between memory node M2 and ground (i.e. in addition to the inherent gate capacitance of transistor T4).

After clock pulse S1 terminates, which opens transistor switch T1*a* and T1*b*, clock pulse S2 closes transistor switch T2. Closing transistor switch T2 couples memory node M1 to a pre-charge voltage, Vp (e.g. approximately 15V), and a charge Q1 is placed across sense capacitor 206 in accordance with the equation, Q1=(Csense)(Vp). Memory node M2 remains at 0V since clock pulse S3 is off at this time.

After clock pulse S2 terminates, which opens transistor switch T2, clock pulse S3 closes transistor switch T3. Closing transistor switch T3 couples memory nodes M1 and M2 to one another and thereby sharing the charge Q1 between sense capacitor 206 and reference capacitor 500. The shared charge Q1 between sense capacitor 206 and reference capacitor 500 results a reference voltage, Vg, at memory node M2 and at the gate of evaluation transistor T4, wherein reference voltage Vg is in accordance with the equation Vg=Vp[Csense/(Csense+Cref)]. The reference voltage Vg remains at memory node M2 until another cycle begins with a next clock pulse S1 grounding memory nodes M1 and M2.

Reference voltage Vg at memory node M2 turn on evaluation transistor T4 which enables a measurement at ID 502 (i.e. the drain of transistor T4). According to one example, transistor T4 is biased in a linear mode of operation, where transistor T4 acts as a resistor having a resistance value which is proportional to the gate voltage which, in this case, reference voltage Vg. According to one example, the drain-to-source resistance, Rds (where the source is coupled to ground) is determined by forcing a small current at ID 502, such as on the order of 1 mA for example). In one example, ID 502 is coupled to a current source, such as current source 130 in printer ASIC 126 (see FIG. 1).

According to one example, firmware, such as Rsense module 128 executing on controller 110 or ASIC 126 (FIG. 1) converts the voltage, VID at ID 502 to resistance Rds using VID and the current at ID 502. Resistance Rds enables a determination of the value of Vg based on the characteristics of transistor T4. In turn, based on the value of Vg, a value of Csense can be found from the equation for Vg shown above, and a level of fluid/ink in chamber 204, and thus in reservoir 107, can be determined based on the value of Csense.

Various techniques can be employed to determine the level of ink in chamber 204 (and thus in reservoir 107) based on the resistance value Rds. For instance, according to one example, the measured value of Rds can be compared to a reference value for Rds, or to a table of values for Rds experimentally determined to be associated with specific ink levels. With no ink present in chamber 204 (i.e. a "dry" signal"), or a very low ink level, the value of sense capacitor 206 is very low. This results in a very low value for Vg (e.g. on the order of 1.7 volts), and the evaluation transistor T4 is off or nearly off (i.e. evaluation transistor T4 is in cut-off of sub-threshold operation region). Therefore, the resistance Rds from ID to ground through evaluation transistor T4 is would be very high (e.g. with ID current of 1.2 mA, Rds is typically above 12 k ohms). Conversely, with a high ink level (i.e. a "wet" signal), the value of sense capacitor 212 is close to 100% of its value, resulting in a high value for Vg (e.g. on the order of 3.5 volts). Therefore, the resistance Rds is low. For example, with a high ink level, Rds is below 1 k ohm (e.g. 300 ohms).

Figure 8:
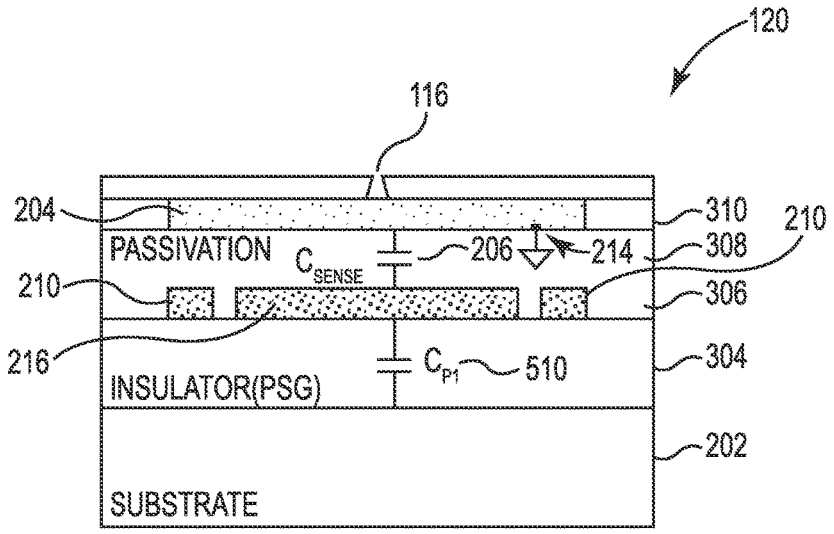
FIG. 8 is cross-sectional view generally illustrating one example of printhead integrated ink level sensor according to one example.

With reference to FIG. 8, which is a cross-sectional view generally illustrating one example of PILS 120, the accuracy of ink levels sensed by PILS 120 via sense capacitor 206 can be adversely effected by an intrinsic parasitic capacitance Cp1 510 formed by metal 216, insulation layer 304, and substrate 202. As described above, PILS 120 determines an ink level in chamber 204 based on the capacitive value of sense capacitor 206. However, when pre-charge voltage Vp is applied to metal plate 216, thereby charging sense capacitor 206, parasitic capacitance Cp1 510 also charges. The charge of parasitic capacitance Cp1 510 can contribute up to 20% of the capacitance value which is determined by sense circuit 220 to be for sense capacitor 206, wherein the percentage varies based on a thickness of insulation layer 304. However, the charge contributed by parasitic capacitance 510 is enough to turn on the evaluation transistor T4 even when there is no fluid/ink present in chamber 204 (i.e. a "dry" state'). As such, parasitic capacitance Cp1 510 distorts the dry/wet signal, potentially resulting in the indication of an ink level being present in chamber 204 when, in fact, in chamber 204 is dry.

Figure 9:
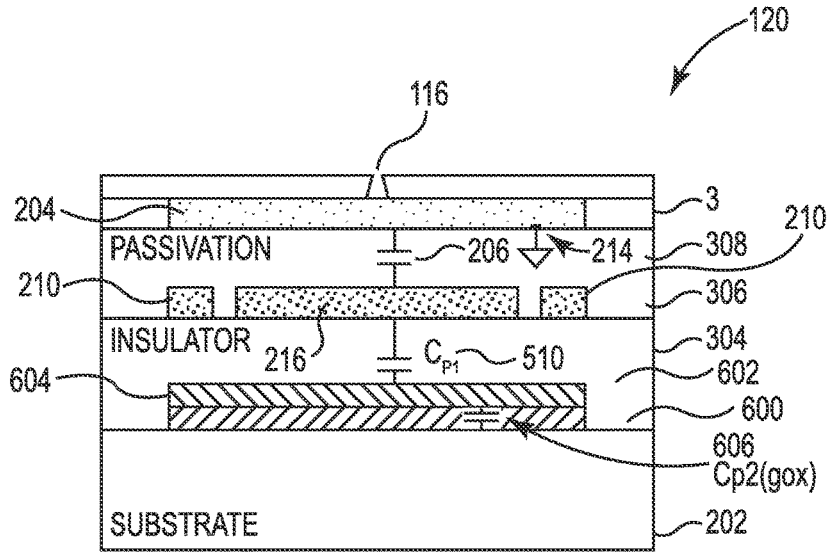
FIG. 9 is a cross-sectional view generally illustrating a printhead integrated ink level sensor including a structure for eliminating parasitic capacitance according to one example.

FIG. 9 is a cross-sectional view generally illustrating one example of PILS 120 including a structure for eliminating the effect of parasitic capacitance Cp1 510. According to one example, a gate oxide (gox) layer 600 is disposed on substrate 202, and a conductive polysilicon layer 602 being disposed on gox layer 600, with conductive polysilicon layer 602 being structured to form parasitic elimination element 604. As described below, parasitic elimination element 604 is configured such that when pre-charge voltage Vp is applied to metal plate 216, pre-charge voltage Vp is also applied to parasitic elimination element 604 of conductive polysilicon layer 602. This presents a charge from developing on parasitic capacitance Cp1 510 so that parasitic capacitance Cp1 510 is effectively eliminated from the determination of the capacitance value of parasitic capacitance Cp1 510. Capacitance Cp2 606 is the parasitic or intrinsic capacitance from parasitic elimination element 604. Cp2 606 slows the charging speed of parasitic elimination element 604, but has no impact on the removal of parasitic capacitance Cp1 510 because there is sufficient charge time provided for parasitic elimination element 604.

Figure 10:
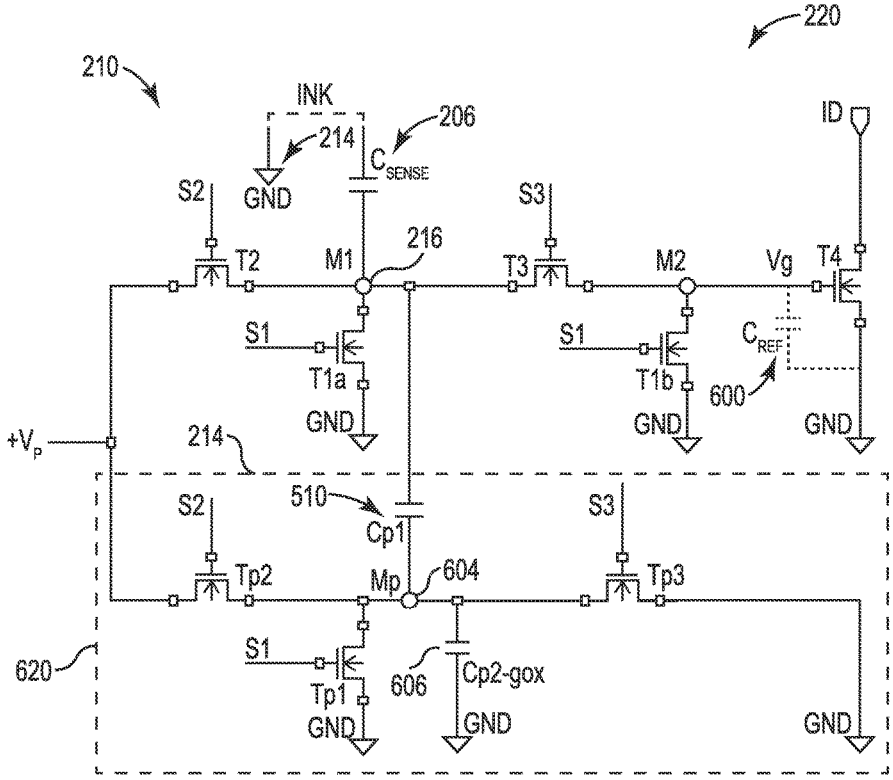
FIG. 10 is a schematic diagram illustrating ink level sensor circuitry of a printhead integrated ink level sensor with a parasitic elimination circuit according to one example.

FIG. 10 is a schematic diagram illustrating ink level sensor circuitry 220 of PILS 120 with a parasitic elimination circuit 620, according to one example. Parasitic capacitance Cp1 510 is indicated as being coupled between metal plate 216 (i.e. node M1) and parasitic elimination element 604 (i.e. node Mp) of conductive polysilicon layer 602. With reference to FIGS. 9 and 10, ink level sensor circuitry 220 is driven with non-overlapping clock signals (S1-S4) as shown in partial timing diagram of FIG. 6.

During operation, clock pulse S1 closes transistor switches T1*a*, T1*b*, and Tp1, which couples memory nodes M1, M2, and Mp to ground, discharging sense capacitor 206, reference capacitor 500, and parasitic capacitance 510. Directly after clock pulse S1 terminates, which opens transistor switches T1*a*, T1*b*, and Tp1, clock pulse S2 closes transistor switches T2 and Tp2. Closing transistor switches T2 and Tp2 couples nodes M1 and Mp to pre-charge voltage, Vp, which places a charge Q1 on sense capacitor 206. However, because nodes M1 and Mp are at the same potential, Vp, no charge develops across parasitic capacitance Cp1 510.

After clock pulse S2 terminates, which opens transistor switches T2 and Tp2, clock pulse S3 closes transistor switches T3 and Tp3. Closing transistor switch T3 couples memory nodes M1 and M2 to one another and shares the charge Q1 between sense capacitor 206 and reference capacitor 500. The shared charge Q1 between sense capacitor 206 and reference capacitor 500 results a reference voltage, Vg, at memory node M2 and at the gate of evaluation transistor T4. Closing transistor switch Tp3 couples parasitic capacitor 510 to ground such that, during clock pulse S3, parasitic capacitor Cp1 510 is discharged, leaving only the charge on sense capacitor 206 to be evaluated with evaluation transistor T4. Since the effect of parasitic capacitor Cp1 510 is removed, parasitic contribution to turn on evaluation transistor T4 during a dry state is greatly reduced.

As described above with reference to FIG. 3, PILS 120 includes a clearing resistor circuit 208. Clearing resistor circuit 208 includes thermal resistors 210 which, along with metal plate 216 of sense capacitor 216, are disposed in metal layer 306 (see FIG. 5) below fluid/ink chamber 204. According to one example, metal layer 306 and, thus, clearing resistors 210 and metal plate 216 are formed of tantalum-aluminum (TaAl). In operation, prior to measuring a fluid/ink level in chamber 204, clearing resistors 210 of clearing resistor circuit 208 are energized which causes them to heat rapidly. The rapid heating of clearing resistors 210 rapidly heats the ink to create vapor bubbles that force ink out of PILS chamber 204 via nozzle 116, thereby purging ink and any ink residue from chamber 204 and removing any ink/ink residue from metal plate 216 of sense capacitor 206. Cleared chamber 204 then refills with fluid/ink from fluid/ink slot 202 and enables an accurate measure of an ink level in chamber 204 via sense capacitor 206. In some implementations, a delay may be provided by controller 110 after activation of clearing resistor circuit 208 to provide sufficient time for ink from slot 202 to refill PILS chamber 204 prior to sensing the level of ink in PILS chamber 204.

Figure 11:
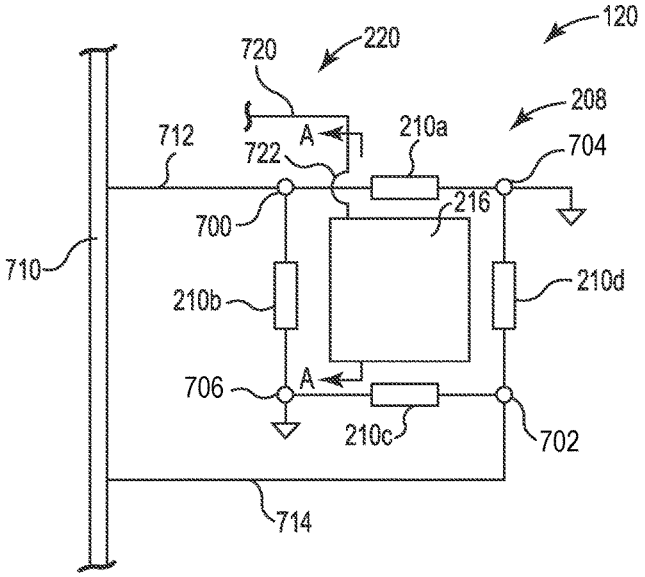
FIG. 11 is a block and schematic diagram generally illustrating a configuration of clearing resistor circuit and portions of sense circuitry including according to one example.

FIG. 11 is a block and schematic diagram generally illustrating a configuration of clearing resistor circuit 208 and portions of sense circuitry 220, including metal plate 216 of sense capacitor 206, according to one example. According to one conventional technique, as illustrated, clearing resistor circuit 208 includes four clearing resistors, illustrated as clearing resistors 210*a*-210*d*, which are positioned so as to surround metal plate 216 of sense capacitor 206. Such a configuration is commonly referred to as a surround-4 configuration.

According to such configuration, clearing resistors 210*a*-210*d* are disposed on each side of metal place 216 of sense capacitor 206. First ends of resistors 210*a* and 210*b* are directly connected to one another, as indicated at node 700, and first ends of resistors 210*c* and 210*d* are directly connected to one another, as indicated at node 702. Second ends of resistors 210*a* and 210*d* are directly connected to one another, as indicated at node 704, and second ends of resistors 210*b* and 210*c* are directly connected to one another, as indicated at node 706. First ends of resistors 210*a* and 210*b* at node 700 are connected to a fire line 710 via a metal lead 712, first ends of resistors 210*c* and 210*d* at node 702 are connected to fire line 710 via a metal lead 714, and the second ends of resistors 210*a* and 210*d* at node 704, and the second ends of resistors 210*b* and 210*c* at node 706 are connected to ground.

While other clearing resistor configurations can be employed, the surround-4 clearing configuration for clearing resistor circuit 208 is desirable because of the efficiency of such configuration in clearing residual ink and residue from fluid/ink chamber relative to other configurations. Additionally, the above described configuration connects the four clearing resistors in parallel with one another between a potential, Vf, provided by fire line 710 and ground, which maximizes the power provided by clearing resistor circuit 208 for clearing residual ink and residue from chamber 204 (i.e. power=(Vf)2/R, where R is the equivalent resistance of clearing resistors 210*a*-210*d*). Connecting first ends of resistors 210*a* and 210*b* to fire line 710 with metal lead 712 and first ends of resistors 210*c* and 210*d* to fire line 710 with metal lead 714 is the most efficient technique for coupling clearing resistors 210*a*-210*d* in parallel, as only two metal leads are employed.

A metal lead 720 (i.e. pre-charge line 720) of sense circuitry 220 in metal layer 306 is connected to metal plate 216 of sense capacitor 206. However, because of the conventional surround-4 configuration of clearing resistors 210*a*-210*d* and the routing of clearing resistor circuitry 208, in order for pre-charge line 720 to connect to metal plate 216, a conductive polysilicon jumper 722 disposed in conductive polysilicon layer 722 is employed to bypass (i.e. is routed below) metal leads (e.g. lead 712) and clearing resistors 210 of clearing resistor circuitry 208.

Figure 12:
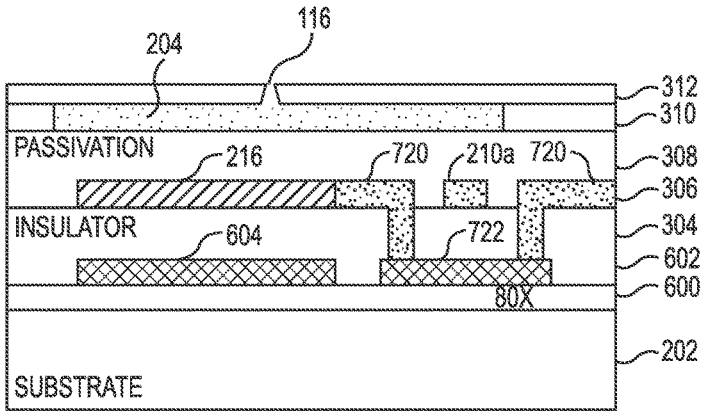
FIG. 12 is a cross-sectional view of a portion of printhead according to one example.

FIG. 12 is a cross-sectional view A-A (see FIG. 11) of a portion of printhead 114 illustrating the routing of pre-charge line 720 and conductive polysilicon jumper 722 for connection of sensor circuitry 220 to metal plate 216 of sense capacitor 206. As illustrated, pre-charge line 720 includes two separate portions routed in metal layer 306 which are coupled to conductive polysilicon jumper 722 in conductive polysilicon layer 602 to bypass clearing resistor 210*a* and associated elements of clearing resistor circuitry 208.

Figure 13:
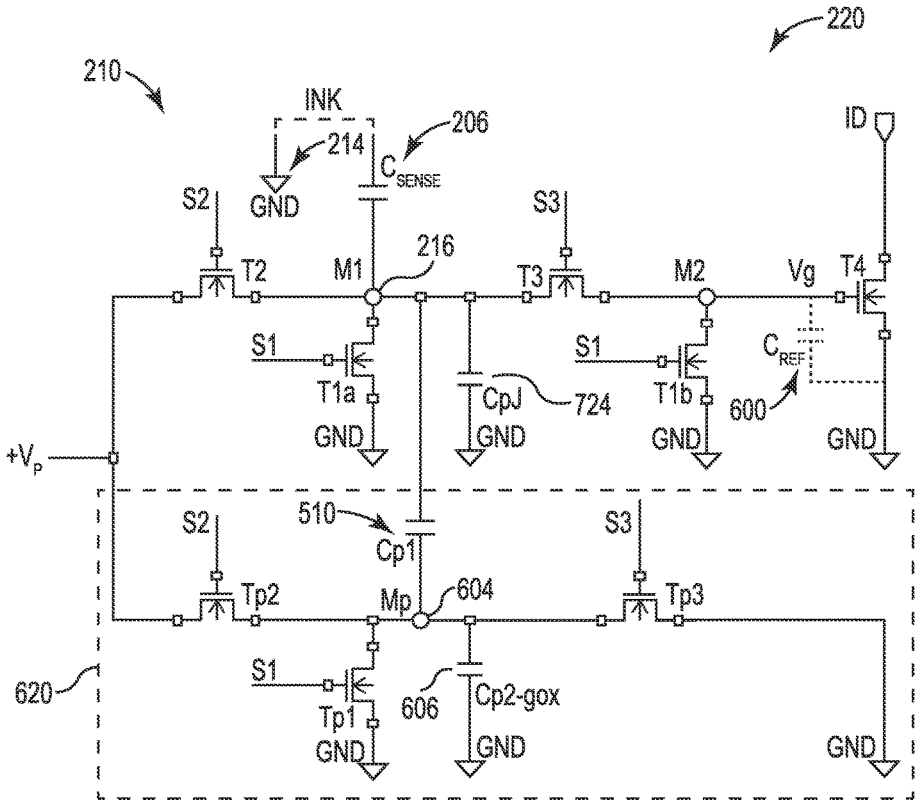
FIG. 13 is a schematic diagram of ink level sensor circuitry including modeling of the effect of parasitic capacitance according to one example.

While such a configuration effectively connects sense circuitry 220 to metal plate 216, the use of conductive polysilicon jumper 722 creates an undesirable parasitic capacitance, CPJ 724, which, in a fashion similar to that of parasitic capacitor Cp1 510, adversely impacts the accuracy of ink level sensing by PILS 120, particularly the "dry" level sensing. FIG. 13 is the schematic diagram of ink level sensor circuitry 220 of FIG. 10 further modeling the effect of parasitic capacitance CPJ 724 resulting from conductive polysilicon jumper 722. The magnitude of the parasitic capacitance CPJ is described by the equation CPJ=eA/d, where "e" is the dielectric constant, "A" is the area of conductive polysilicon jumper 722, and "d" is the distance between the polysilicon jumper 722 and substrate 202. The larger the magnitude of parasitic capacitance, CPJ 724 the greater the adverse impact to accurate ink level sensing, particularly "dry" level sensing, by PILS 120.

Figure 14:
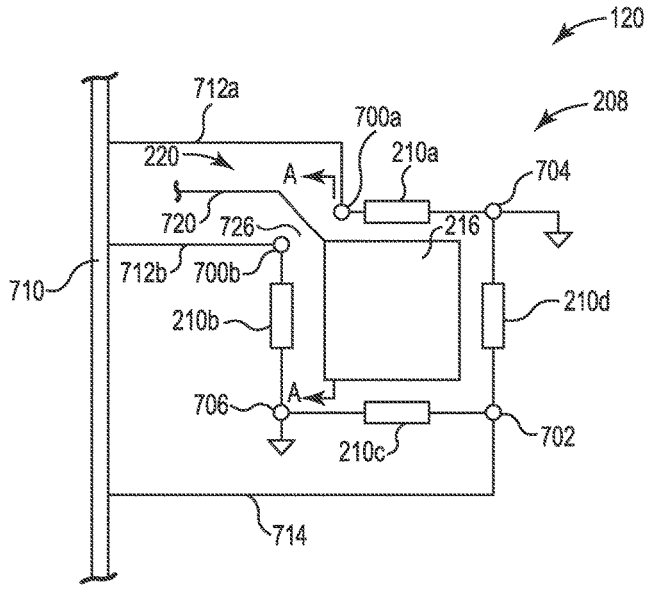
FIG. 14 is a block and schematic diagram generally illustrating a configuration of a clearing resistor circuit and portions of sense circuitry according to one example of the present disclosure.

FIG. 14 is a block and schematic diagram generally illustrating a configuration of clearing resistor circuit 208 and portions of sense circuitry 220, according to one example of the present disclosure, which eliminates conductive polysilicon jumper 722 and the associated parasitic capacitance, CPJ 724 while still employing a surround-4 clearing resistor configuration, thereby improving the accuracy of ink level sensing by PILS 120, particularly "dry" level ink sensing, while maintaining the advantages of a surround-4 configuration of clearing resistor circuitry 208.

As illustrated, according to one example, rather than using a single metal lead 712 to connect fire line 710 to the first ends of clearing resistors 210*a* and 210*b* (as employed by the conventional configuration of FIG. 11), clearing resistor circuit 208 respectively employs separate metal leads 712*a* and 712*b* to separately connect to the first end 700*a* or 700*b*, respectively, of each clearing resistor 210*a* and 210*b* to fire line 710. According to such configuration, the four clearing resistors 210*a*-210*d* remain in a surround-4 configuration and remain connected in parallel between a potential Vf of fire line 710 and ground, but a gap 726 is provided in metal layer 306 between clearing resistors 210*a* and 210*b*.

Pre-charge line 720 of sense circuitry 220 is routed through gap 726 and directly connects to metal plate 216 of sense capacitor 206 without requiring a polysilicon jumper, such as polysilicon jumper 722, in conductive polysilicon layer 602 to route around (i.e. below) elements of clearing resistor circuit 208. By eliminating the need for polysilicon jumper 722, the associated parasitic capacitance, CPJ 724 is also eliminated so that, according to one example, PILS 120 and sense circuitry 220 function to measure the ink level in fluid/ink chamber 204 as described and illustrated above by FIG. 10.

By configuring clearing resistor circuitry 208 so that the adjacent ends of at least two of the clearing resistors 210 of the surround-4 configuration are not directly coupled to one another, such as first ends of clearing resistors 210*a* and 210*b*, for example, a gap is created there between in metal layer 306, such as gap 726, through which pre-charge line 720 can be routed entirely within metal layer 306 and directly coupled to metal plate 716 of sense capacitor 206 without the need for polysilicon jumper 722. For instance, in the illustrated example of FIGS. 14 and 15, using three metal leads (i.e. metal leads 712*a*, 712*b*, and 714) to connect the surround-4 configuration of clearing resistors 210*a*-210*d* in parallel with one another to fire line 710 provides gap 726 between first ends of clearing resistors 210*a* and 210*b* through which pre-charge line 720 can be routed.

Eliminating polysilicon jumper 722 eliminates the associated parasitic capacitance CPJ 724 and its adverse effects on the accuracy of ink level sensing by PILS 120 (see FIG. 13) so that PILS 120 functions as described and illustrated by FIG. 10, for example. Eliminating parasitic capacitance CPJ 724 resulting from polysilicon jumper 722 results in the measured "wet" and "dry" capacitance levels of sense capacitor 206 being separated from one another by a greater magnitude, thereby improving the accuracy and reliability of sensed ink levels by PILS 120.

As described above with reference to FIG. 7, firmware, such as Rsense module 128 executing on controller 110 or ASIC 1226 (FIG. 1) determines a resistance Rds based ultimately on the capacitance value of sense capacitor Csense 206 to determine a level of ink in fluid/ink chamber 204. The difference between the value of Rds when fluid/ink chamber 204 is full (i.e. "wet" signal) and when fluid/ink chamber 204 is empty (i.e. "dry" signal) is desired to be large in order to provide accurate and consistent ink level measurements. In one example, the wet signal value of Rds is below 1 k ohm (e.g. several hundreds of ohms) and the dry signal value of Rds is above 12 k ohm. The presence of parasitic capacitance CPJ 724 resulting from polysilicon jumper 722 causes the dry signal value of Rds to be much lower than 12 k ohm, thereby causing dry signal to be inaccurate. Elimination of parasitic capacitance CPJ 724 in accordance with the present disclosure provides a dry signal value of Rds which is consistently in 12 k ohm range and thereby provides a more accurate ink level measurement when the ink level in fluid/ink chamber 204 is at low levels.

Figure 16:
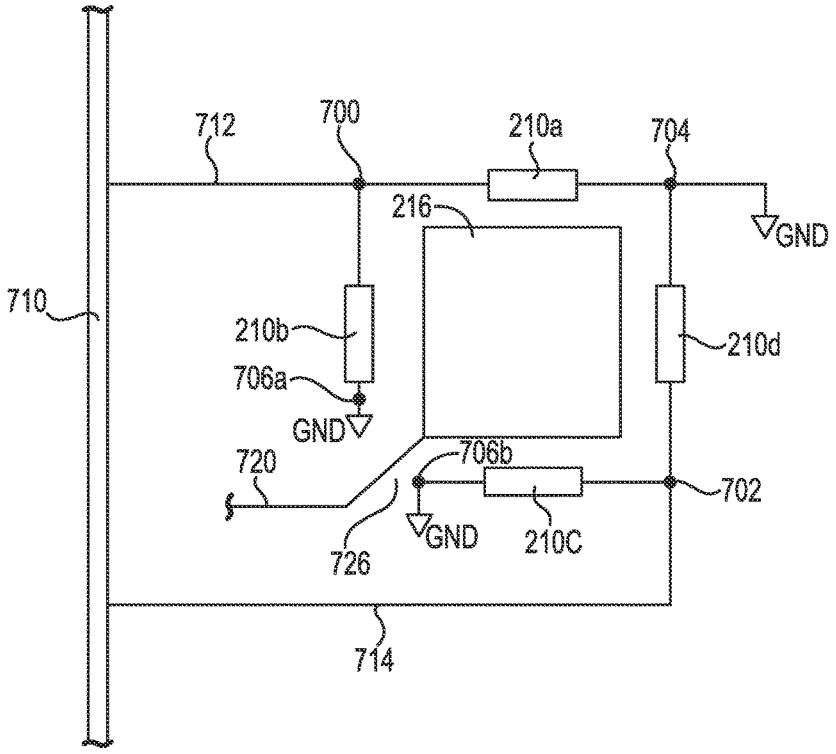
FIG. 16 is a block and schematic diagram generally illustrating a configuration of a clearing resistor circuit and portions of sense circuitry according to one example of the present disclosure.

As illustrated by FIG. 16, in one example, in lieu of forming gap 726 in single metal layer 306 by splitting node 700 (into 700*a* and 700*b*) and separately connecting clearing resistors 210*a* and 210*b* to fire line 710, node 706 is split (706*a*, 706*b*) and the second ends of clearing resistors 210*b* and 210*c* are separately connected to ground to form gap 726. Pre-charge line 720 of sense circuitry 220 is routed through gap 726 and directly connects to metal plate 216 of sense capacitor 206 and eliminates the need for polysilicon jumper 722 in a fashion similar to that of the configuration of FIG. 14.

While clearing resistors 210 are illustrated above in a surround-4 configuration, a number of clearing resistors 210 other than four may be configured in a "surround" configuration about the perimeter of the metal plate 216 of sense capacitor 206. For example, in other examples, three clearing resistors may be employed and disposed in a surround configuration about metal plate 216, where the three resistors are electrically connected in parallel and connected end-to-end, except for the adjacent ends of two of the three resistors so as to form a gap 726 there between. In other examples, more than four clearing resistors may be disposed in a surround configuration about metal plate 216, where the resistors are electrically connected in parallel and connected end-to-end, except for the adjacent ends of two the clearing resistors, so as to form a gap 726 there between. Additionally, although illustrated as being rectangular in shape, metal plate 216 may be of any number of shapes, such as circular, for example.

Figure 17:
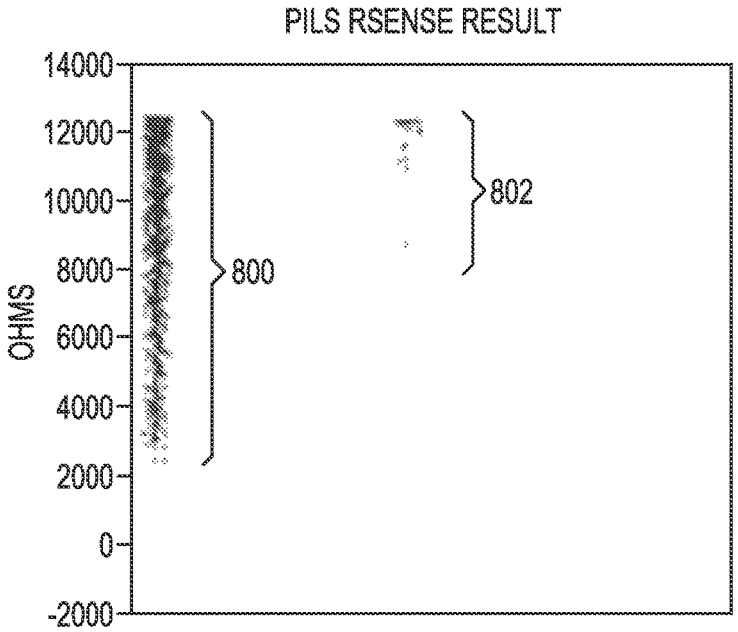
FIG. 17 is a graph illustrating measured dry signal values of sensed resistance of a printhead integrated ink level sensor according to one example of the present disclosure.

FIG. 17 is a graph illustrating measured dry signal values of Rds when parasitic capacitance CPJ 724 resulting from polysilicon jumper 722 is present in PILS 120, according to conventional PILS configurations, and when polysilicon jumper 722 is eliminated from PILS 120, thereby eliminating parasitic capacitance CPJ 724, in accordance with the present disclosure. As can be seen by the groupings of measured values of Rds for PILS 120 according to conventional configurations, as indicated at 800, the dry signal values of Rds vary greatly, and frequently, over a range from just above 2 k ohms to above 12 k ohms. Such variation results in inaccurate and inconsistent low-on-ink (LOI) measurements when ink levels are low in fluid/ink chamber 204.

Conversely, as indicated by the groupings of measured values of Rds for PILS 120 according to the present disclosure, as indicated at 802, where polysilicon jumper 722 has been eliminated, the dry signal values of Rds vary little typically over a range from 11 k ohms to above 12 k ohms, with an outlier of approximately 9 k ohms. Such improved variation results in accurate and consistent LOI measurements when ink levels are low in fluid/ink chamber 204. Such accurate ink level measurements, including accurate LOI measurements enable printing systems, such as printer system 100, to initiate actions to help prevent low quality prints and prevent premature replacement of ink cartridges that might still contain ink, for example.

Figure 18:
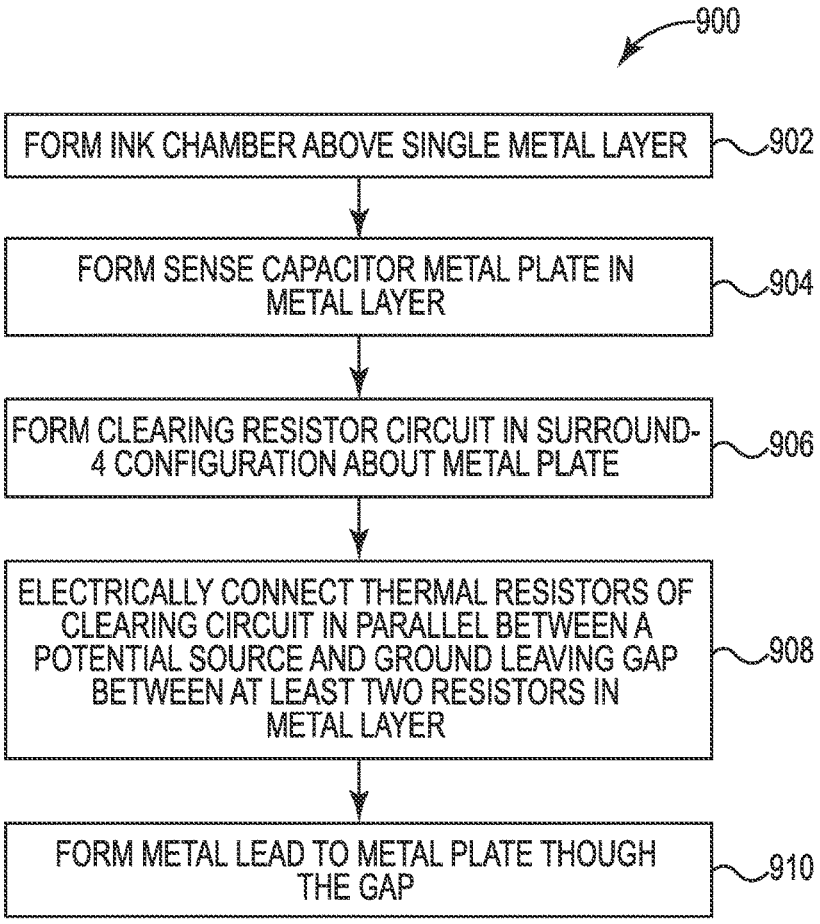
FIG. 18 is a flow diagram illustrating a method of fabricating a fluid ejection device according to one example of the present disclosure.

FIG. 18 is a flow diagram illustrating a method 900 of fabricating a fluid ejection device according to one example of the present disclosure, wherein the fluid ejection device includes a printhead die having a plurality of layers, including a single metal layer. Method 900 begins at 902 with forming an ink chamber in a layer above the single metal layer, such as fluid/ink chamber 204 in chamber layer 304 above single metal layer 306 in FIG. 15. At 904, method 900 includes forming a metal plate of a sense capacitor in the single metal layer, wherein the metal plate is disposed below the ink chamber, such as metal plate 216 of sense capacitor 206 in metal layer 306 being disposed below ink chamber 204 in FIG. 15. At 906, a clearing resistor comprising four thermal resistors is formed in the metal layer in a surround-4 configuration about the metal plate, such as thermal resistors 210*a*-210*d* about metal plate 216 in FIGS. 14 and 15.

Figure 15:
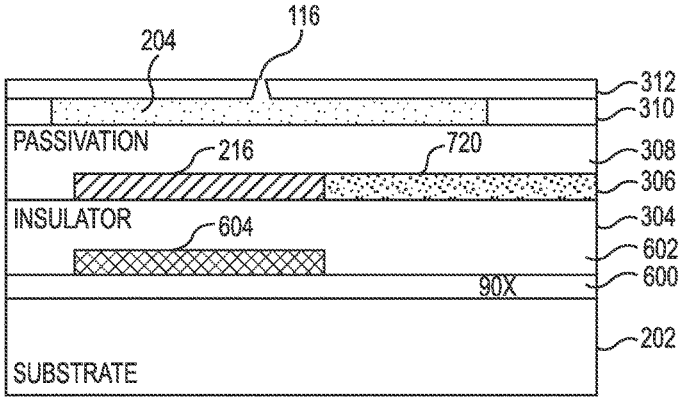
FIG. 15 is a cross-sectional view of a portion of printhead according to one example.

At 908, the four thermal resistors are electrically connected in parallel with one another between a voltage potential and ground, such as resistors 210*a*-210*d* being connected in parallel between fire line 710 and ground in FIG. 14. The adjacent ends of at least two thermal resistors are not directly connected to one another so as to leave a gap between the adjacent ends in the metal layer, such as the ends of thermal resistors 210*a* and 210*b* not being directly connected to one another, but instead being separately connected to fire line 710 by metal lines 712*a* and 712*b* so as to form gap 726 there between in metal layer 306 as illustrated in FIG. 14. At 910, a metal lead is formed in the metal layer that so as to extend through the gap and electrically connect to the metal plate of the sense capacitor, such as metal lead 720 extending in metal layer 306 through gap 726 to electrically connect to metal plate 216 of sense capacitor 206 as illustrated by FIGS. 14 and 15.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluid ejection device comprising:

a printhead die having a plurality of layers, including a single metal layer, and having an integrated ink level sensor comprising:

an ink chamber above the metal layer;

a metal plate of a sense capacitor disposed in the metal layer;

a clearing resistor circuit disposed in the metal layer including a plurality of clearing resistors arranged in a surround configuration about a perimeter the metal plate and electrically connected in parallel between a voltage potential and ground, wherein adjacent ends of at least two clearing resistors are not directly connected to one another so as to leave a gap between the adjacent ends in the metal layer; and a metal lead in the metal layer extending through the gap to the metal plate.

2. The fluid ejection device of claim 1, wherein the metal lead comprises a pre-charge line for charging the sense capacitor.

3. The fluid ejection device of claim 1, wherein the printhead die includes an ink slot, the ink chamber being in fluid communication with the ink slot, and wherein the ink slot is in fluid communication with an ink reservoir.

4. The fluid ejection device of claim 1, wherein:

a first end of a first clearing resistor is connected to the voltage potential by a first metal lead in the metal layer;

a first end of a second clearing resistor is connected to the voltage potential by a second metal lead in the metal layer;

first ends of a third clearing resistor and a fourth clearing resistor are connected together and connected to the voltage potential by a third metal lead in the metal layer;

second ends of the first and fourth clearing resistors are connected together and connected to ground; and second ends of the second and third clearing resistors are connected together and coupled to ground, such that the gap is between the first ends of the first and second clearing resistors.

5. The fluid ejection device of claim 4, wherein the metal plate of the sense capacitor is rectangular in shape, and wherein the clearing resistor circuit comprises the first, second, third, and fourth clearing resistors, wherein each of the first, second, third, and fourth clearing resistors is aligned parallel to a corresponding side of the metal plate.

6. The fluid ejection device of claim 4, wherein a combined width of the first and second metal leads is at least equal to a width of the third metal lead.

7. The fluid ejection device of claim 1, further comprising:

an electrical line to supply the voltage potential, wherein the adjacent ends of the at least two clearing resistors of the clearing resistor circuit are connected by respective metal leads to the electrical line.

8. The fluid ejection device of claim 7, wherein a first end of a first clearing resistor of the at least two clearing resistors is connected by a first metal lead to the electrical line, and a first end of a second clearing resistor of the at least two clearing resistors is connected by a second metal lead to the electrical line, the adjacent ends comprising the first end of the first clearing resistor and the first end of the second clearing resistor, and the gap is between the first end of the first clearing resistor and the first end of the second clearing resistor.

9. The fluid ejection device of claim 7, wherein the metal lead in the metal layer is to supply another voltage potential to the metal plate of the sense capacitor.

10. The fluid ejection device of claim 9, wherein the metal leads connected to the electrical line are formed in the metal layer.

11. A die for a fluid ejection device, the die comprising:

a plurality of layers including metal layer; and a fluid level sensor comprising:

a fluid chamber above the metal layer;

a metal plate of a sense capacitor disposed in the metal layer;

an electrical line to supply a voltage potential;

a clearing resistor circuit disposed in the metal layer including a plurality of clearing resistors arranged in a surround configuration about a perimeter of the metal plate and electrically connected in parallel between the voltage potential and ground, wherein adjacent ends of at least two clearing resistors of the clearing resistor circuit are not directly connected to one another so as to leave a gap between the adjacent ends in the metal layer, the adjacent ends of the at least two clearing resistors connected by respective metal leads formed in the metal layer to the electrical line; and a further metal lead in the metal layer extending through the gap to the metal plate.

12. The die of claim 11, wherein the further metal lead comprises a pre-charge line for charging the sense capacitor.

13. The die of claim 11, wherein the die includes a fluid slot, the fluid chamber being in fluid communication with the fluid slot.

14. The printhead die of claim 11, wherein:

a first end of a first clearing resistor is connected to the voltage potential by a first metal lead in the metal layer;

a first end of a second clearing resistor is connected to the voltage potential by a second metal lead in the metal layer;

first ends of a third clearing resistor and a fourth clearing resistor are connected together and connected to the voltage potential by a third metal lead in the metal layer;

second ends of the first and fourth clearing resistors are connected together and connected to ground; and second ends of the second and third clearing resistors are connected together and coupled to ground, such that the gap is between the first ends of the first and second clearing resistors.

15. The die of claim 14, wherein the metal plate of the sense capacitor is rectangular in shape, and wherein the clearing resistor circuit comprises the first, second, third, and fourth resistors, wherein each of the first, second, third, and fourth clearing resistors is aligned parallel to a corresponding side of the metal plate.

16. The printhead die of claim 14, wherein a combined width of the first and second metal leads is at least equal to a width of the third metal lead.

17. A method of fabricating a fluid ejection device including a printhead die having a plurality of layers including a single metal layer, the method comprising:

forming an ink chamber in a layer above the metal layer;

forming a metal plate of a sense capacitor in the metal layer below the ink chamber;

forming a clearing resistor circuit in the metal layer including a plurality of thermal resistors arranged about a perimeter of the metal plate in a surround configuration;

electrically connecting the plurality of thermal resistors in parallel with one another between a voltage potential and ground such that adjacent ends of at least two clearing resistors are not directly connected to one another so as to leave a gap between the adjacent ends in the metal layer; and forming a metal lead in the metal layer that extends through the gap and electrically connects to the metal plate of the sense capacitor.

18. The method of claim 17, wherein electrically connecting the plurality of thermal resistors comprises:

connecting a first end of a first thermal resistor to the voltage potential with a first metal lead in the metal layer;

connecting a first end of a second thermal resistor to the voltage potential with a second metal lead in the metal layer;

connecting first ends of a third thermal resistor and a fourth clearing resistor to the voltage potential with a third metal lead in the metal layer;

connecting second ends of the first and fourth thermal resistors together to ground; and connecting second ends of the second and third thermal resistors together and to ground, such that the gap is between the first ends of the first and second thermal resistors, wherein the clearing resistor circuit comprises the first, second, third, and fourth thermal resistors.

19. The method of claim 17, wherein the first metal lead, second metal lead, and third metal lead are formed such that a combined width of the first and second metal leads is at least equal to a width of the third metal lead.

20. The method of claim 17, further comprising:

electrically connecting the adjacent ends of the at least two clearing resistors by respective metal leads formed in the metal layer to an electrical line that supplies the voltage potential.

* * * * *